US005127801A

United States Patent [19]

Mortensen

[11] Patent Number: 5,127,801

[45] Date of Patent: Jul. 7, 1992

[54] IMPELLER FOR AN AXIAL FLOW FAN

[75] Inventor: Bent M. Mortensen, N stved, Denmark

[73] Assignee: Novenco A/S, Denmark

[21] Appl. No.: 585,053

[22] PCT Filed: Jun. 6, 1989

[86] PCT No.: PCT/DK89/00140

§ 371 Date: Oct. 16, 1990

§ 102(e) Date: Oct. 16, 1990

[87] PCT Pub. No.: WO89/12172

PCT Pub. Date: Dec. 14, 1989

[30] Foreign Application Priority Data

Jun. 9, 1988 [DK] Denmark ..... 3130/88

[51] Int. Cl.[5] ..... F01D 7/00

[52] U.S. Cl. ..... 416/205; 416/219 A

[58] Field of Search ..... 416/87, 89, 156, 168 R, 416/204 R, 205, 214 A, 214 R, 220 A

[56] References Cited

U.S. PATENT DOCUMENTS

| | | | |
|---|---|---|---|
| 2,566,696 | 9/1951 | Cushman | 416/89 |
| 4,573,874 | 3/1986 | Andersen et al. | 416/205 |
| 4,579,510 | 4/1986 | Dalsgaard | 416/205 |
| 4,844,647 | 7/1989 | Johansen | 416/168 R |

FOREIGN PATENT DOCUMENTS

| | | | |
|---|---|---|---|
| 145552 | 4/1950 | Australia | 416/205 |
| 463107 | 2/1950 | Canada | 416/205 |
| 2241768 | 3/1974 | Fed. Rep. of Germany | 416/168 |
| 703458 | 2/1954 | United Kingdom | 416/168 R |

*Primary Examiner*—Edward K. Look
*Assistant Examiner*—Michael S. Lee
*Attorney, Agent, or Firm*—Sughrue, Mion, Zinn, Macpeak & Seas

[57] ABSTRACT

An impeller for an axial flow fan having adjustable veins which are suspended in a rigid supporting ring. The ring is centered and fastened by radial supporting plates which comprise at their periphery circumferential collar elements which engage with recesses on opposite sides of supporting ring. The supporting plates are connected with the supporting rings using bolts and are connected to each other by a spacer element. The spacer element also forms a slide guide for an axially movably adjusting disk. The veins are suspended in the supporting ring so that they may be individually adjusted.

8 Claims, 3 Drawing Sheets

IMPELLER FOR AN AXIAL FLOW FAN

Figure 1:
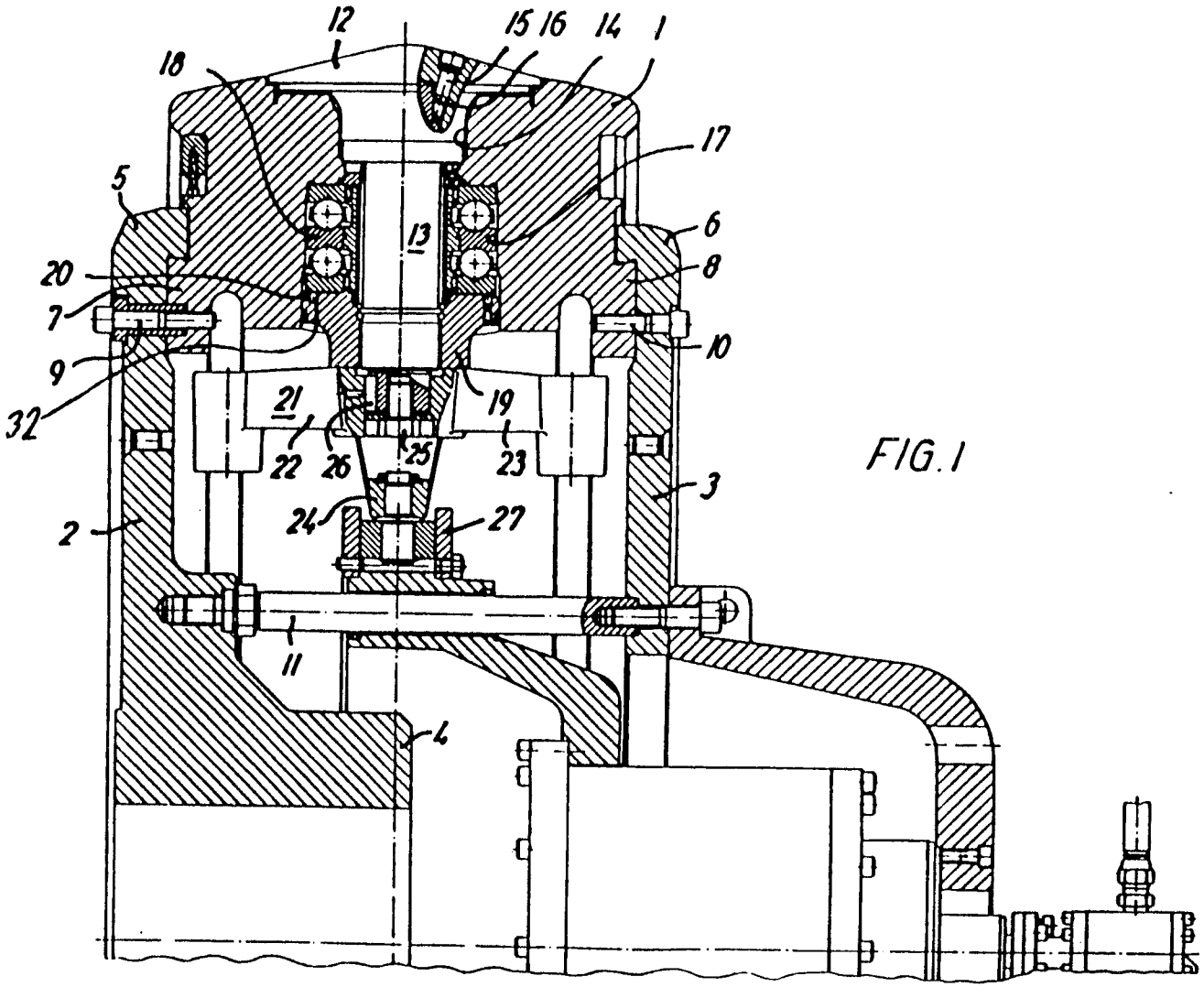

This invention relates to an impeller for an axial flow fan having vanes each of which is adjustably mounted each of which is mounted and connected with a vane pitch control device arranged internally in the impeller for simultaneous adjustment of all the vanes during operation for simultaneous adjustment of all the vanes during operation.

In conventional axial flow fans the impeller comprises usually an impeller ring in which the vanes are suspended in rigid connection with a hub section, and the impeller ring and the hub section have mostly been constructed as a casted unit which complicates and increases the cost of the manufacture, especially in the case of large and relatively high speed impellers which under operation must be able to take up a considerable amount of dynamic load due to the centrifugal force, the adjustment forces etc.

With a view of simplifying and reducing the cost of manufacture, especially of very large impellers, a construction is known from Danish patent no. 149694 in which the vanes are suspended in a supporting ring connected with front and back plates through welded joints with the particular ability of having a certain resiliency in the radial direction so that the forces are mainly taken up by the supporting ring itself. Although this construction entails various advantages, it is subjected to limitations with respect to loading just as a result of the resilient welded joints, and it is especially less suitable for use in fans with variable speed where a change of the number of revolutions produces big momentary loads on the impeller.

It is an object of the invention to provide an impeller of the type mentioned which remedies these problems and moreover has the advantage of being composed of relatively uncomplicated individual parts connected in such a way that they can take up a very considerable amount of load and changes of load which make the impeller suitable for use in high speed fans with variable number of revolutions, and in addition it is made possible with regard to the tolerances in the impeller to individually adjust the vanes in order to obtain an optimal adaption of the play between the vane edges and the surrounding casing.

This is achieved according to the invention in that the vanes are suspended in a rigid supporting ring which is centered and kept in position by means of mainly radial supporting plates one of which forms a connection to a hub section journalled on a drive shaft, said supporting plates having circumferential collar parts engaging recesses on opposite sides of the supporting ring and being furthermore connected with the supporting ring by means of parallel connecting bolts and being connected with each other by distance members parallel to the axes and forming slide guides for said vane pitch control device designed as an axially movable control disc, the vanes being suspended in said supporting ring so as to be individually adjustable in their axial direction.

In the impeller according to the invention the supporting ring and the supporting plates are preferably designed as forged pieces. The engagement between the supporting ring and the supporting plates provides an accurate centering of the supporting ring and at the same time the connecting bolts offer the possibility of obtaining an easy access to the interior of the impeller for inspection of the vane suspension bearings and the control means.

In a preferred embodiment each vane is fixed in a predetermined angular position on one end of a short vane shaft extending through a bore provided in the supporting ring and forming at the inner side of the supporting ring a bearing casing for a vane suspension bearing which is kept in position in the bearing casing by means of a nut screwed onto said vane shaft and forming a bottom of the bearing casing, a vane balancing device and a control arm connected with said control disc being formed as an integral unit which is removably retained in the axial direction and in a predetermined angular position on the other end of said vane shaft, said nut being turnable between a number of discrete angular positions relative to said integral unit.

By this construction a simple possibility is achieved for adjusting the vanes in their axial direction by turning said nut between said discrete angular positions relative to the balancing and control unit.

Moreover it is preferred that the diameters of said supporting plates is greater than the outer diameter of the supporting ring, said supporting plates accommodating at their circumference an impeller rim which is centered by means of radial guides on the supporting plates and fixed with the supporting plates by means of bolts.

Hereby it is obtained that the impeller rim is formed by an independent element whereby impellers with different diameters can be manufactured only by changing the length of the blade shaft, but without changing the supporting ring and the remaining parts inside the hub.

Figure 2:
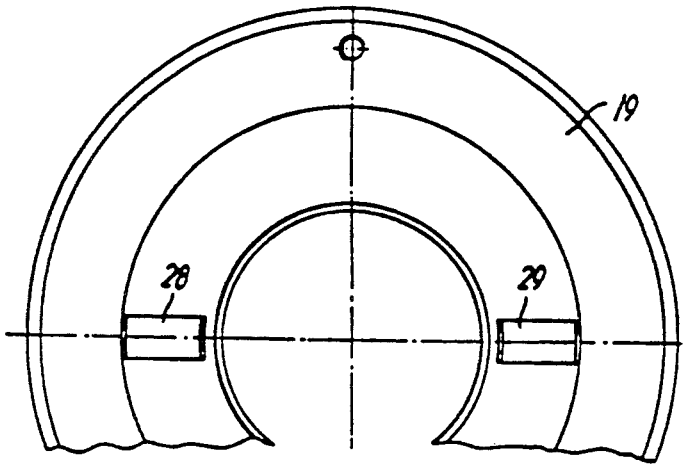
Figure 3:
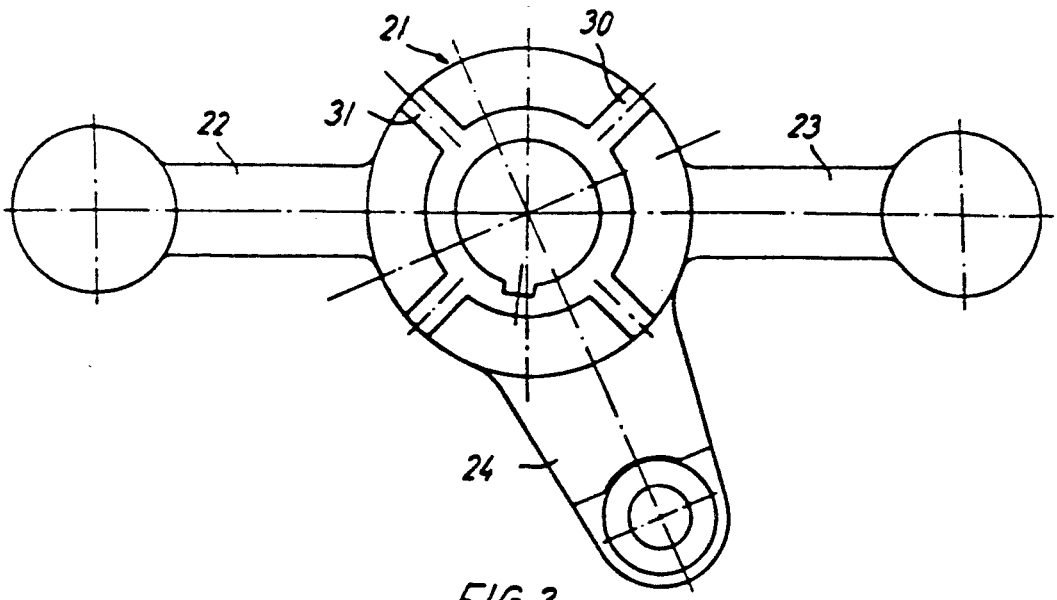
Figure 4:
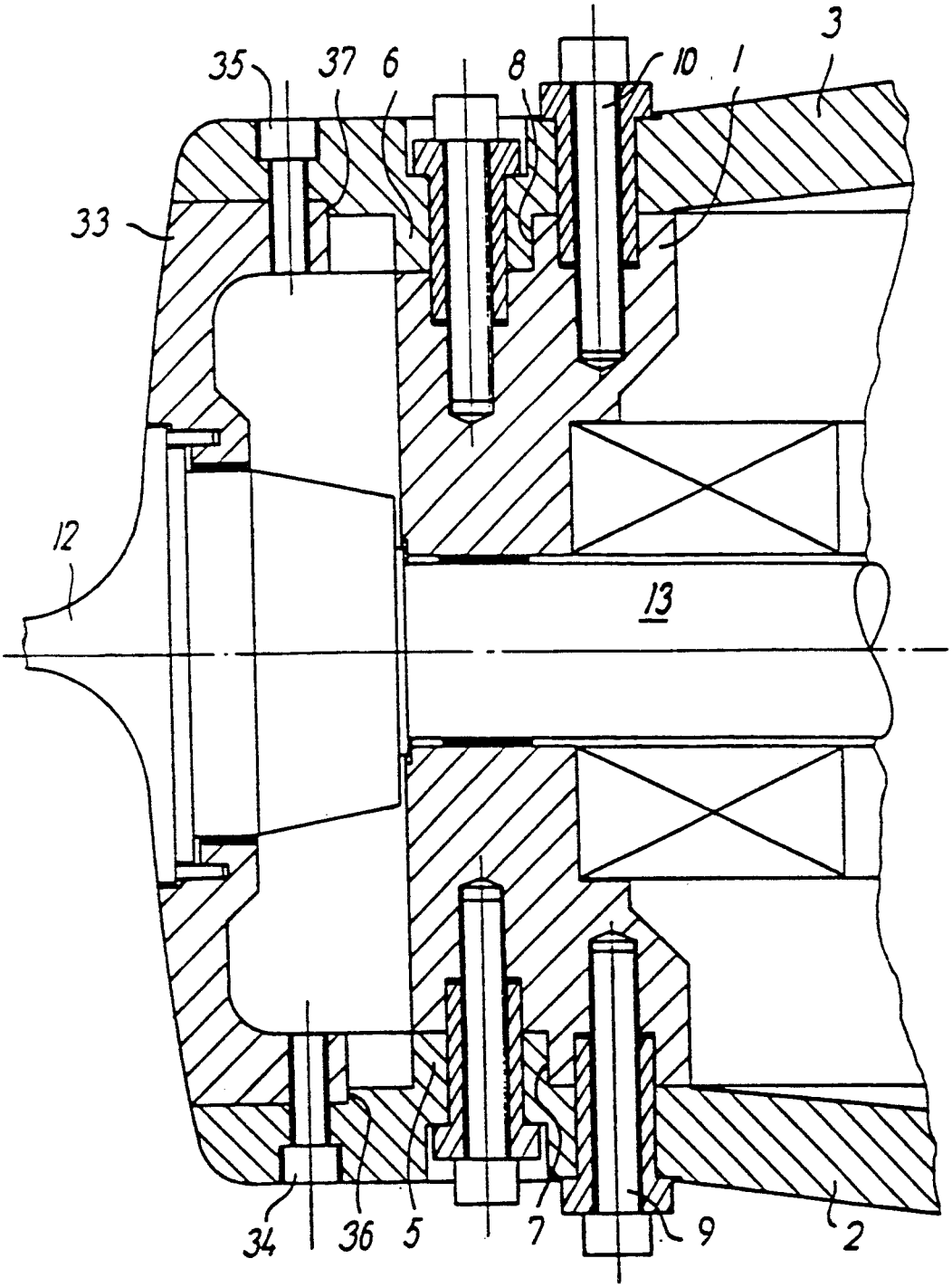

The invention will now be explained in more detail with reference to the drawings in which FIG. 1 is an axial cross-sectional view of an embodiment of an impeller for an axial flow fan according to the invention, FIG. 2 and 3 illustrate matching engagement means of a nut which forms the bottom of the bearing casing for a vane suspension bearing, and of a balancing and control unit, and FIG. 4 is an axial partial sectional view of another embodiment of an impeller for an axial flow fan according to the invention.

The impeller illustrated in FIG. 1 comprises a vane supporting ring 1 in rigid connection with a rear supporting plate 2 and a front supporting plate 3. The supporting plates 2 and 3 keep the supporting ring centered in relation to the drive shaft (not shown), on which a hub section 4 arranged in the lower part of the back plate 2 is fastened, in that each supporting plate comprises at its periphery a collar part 5 and 6, respectively, projecting towards the supporting ring and engaging with opposite sides of the supporting ring 1 on the external side of the opposite recesses 7 and 8.

In the axial direction the supporting ring 1 is connected with the supporting plates 2 and 3 by means of connecting bolts 9 and 10, and the supporting plates 2 and 3 are moreover connected with each other by distance members 11 parallel to the axis.

The supporting ring 1 serves for suspension and journalling of the vanes (not shown per se) so that their pitch can be adjusted during rotation of the impeller.

In the embodiment shown each vane foot 12 is screwed on the outer end of a relatively short vane tap 13 which is guided through a bore 14 in the supporting ring 1. The vane foot 12 is thereby fixed in a certain vane pitch relative to the vane shaft 13 by engagement between a wedge-shaped locking pin 15 screwed in through the vane shaft 12 and a matching groove 16 in the end of the vane shaft 13.

On the inner side of the supporting ring 1 the bore 14 forms a bearing casing 17 to receive a contrarotative axial thrust bearing 18 of the type disclosed in applicants Danish patent application no. 6233/86.

The bottom of the bearing casing 17 is formed by a nut 19 screwed on the vane shaft 13 and which with a view of sealing against an oil lubricant introduced in the bearing casing 17 is sealed in relation to the bearing casing by means of a seal ring 20. To take up thermal expansion of oil lubricants a duct 32 may be provided in the top side of the nut 19.

Under the nut 19 a balancing and control unit 21 is arranged on the vane shaft 13, said unit comprising two balancing arms 22 and 23 and a control arm 24.

The unit 21 is removably fastened on the end of the vane shaft 13 by means of a set screw 25 and is secured against angular turning in relation to the vane shaft by means of a feather and groove engagement 26.

The control arm 24 is in engagement with a control disc 27 which in a known manner is axially movably in the impeller by means of a hydraulic control device whereby the distance members 11 parallel to the axis form slide guides for the axial movement and the control disc 27 by means of which adjustment of the vane pitch of all the vanes can be effected simultaneously during rotation of the impeller.

In order to enable the individual adjustment of the vanes in their longitudinal direction the nut 19 and the unit 21, shown in FIG. 2 and 3, are formed on the sides facing each other with matching engagement means permitting the nut 19 to adopt one out of a number of discrete angular positions in relation to the unit 21 which in it self is kept in a fixed angular position in relation to the vane shaft 13 and consequently in relation to the vane shaft 12 and the vane not shown.

Said engagement means may, as shown, be formed as two diametrically and in relation to each other downwardly projecting ribs 28 and 29 on the underside of the nut 19 and two grooves 30 and 31 matching thereto and intersecting each other perpendicularly on the top side of the unit 21.

The individual adjustment can be performed in that the set screw 25 is loosened whereby the engagement between the unit 21 and the nut 19 is liberated, and the nut 19 can now be turned in steps of 90° before engagement with the unit 21 is reestablished by fastening the set screw 25.

FIG. 4 shows another embodiment in which the periphery of the impeller is formed by an independent impeller rim 33. Said rim is fastened between the supporting plates 2 and 3 by means of the connecting bolts 34 and 35 and is centered by means of circumferential recesses 36 and 37 in the supporting plates. In this embodiment the diameter of the impeller can be changed by changing the diameter of the supporting plates and the impeller rim or of the impeller rim alone depending of its actual form, and by adapting the length of the vane shaft 13, but without changing the supporting ring and the remaining internal parts inside the hub.

I claim:

1. An impeller for an axial flow fan said impeller comprising:

a hub section journalled on a drive shaft, a rigid supporting ring, radial supporting plates having axially projecting circumferential collar parts engaging recesses on opposite sides of the supporting ring, said radial supporting plates being further connected with the supporting ring by means of parallel connecting bolts and being connected with each other by distance members parallel to the axes of rotation of the impeller, vanes being suspended in said supporting ring to be individually adjustable in their longitudinal directions, and a vane pitch control device comprising an axially movable control disc for simultaneous adjustment of all the vanes during operation, said parallel connecting bolts forming slide guides for said control disc.

2. An impeller as claimed in claim 1, wherein each vane is fixed in a predetermined angular position on one end of a short vane shaft extending through a bore provided in the supporting ring and forming at the inner side of the supporting ring a bearing casing for a vane suspension bearing which is maintained in position in the bearing casing by a nut screwed onto said vane shaft and forming a bottom of the bearing casing, a vane balancing device and a control arm connected with said control disc being formed as an integral unit which is retained removably in the longitudinal direction and in a predetermined angular position on the other end of said vane shaft, means for defining discrete angular positions of the nut relative to the integral unit.

3. An impeller as claimed in claim 1, wherein each vane is fixed in said angular position on the vane shaft by engagement between a locking pin retained in a bore in the vane foot and a groove formed parallel to the longitudinal direction in said one end of the vane shaft.

4. An impeller as claimed in claim 2, wherein said unit is fixed in said angular position on the other end of the vane shaft (13) by means of a feather and groove engagement (26).

5. An impeller as claimed in claim 2, wherein the underside of said nut (19) and the upper side of said integral unit are provided with matching engagement means in the form of grooves in one part and projecting ribs adapted thereto on the other part.

6. An impeller as claimed in claim 5, wherein the upper side of said unit is provided with two groove intersecting each other substantially perpendicularly.

7. An impeller as claimed in claim 2, wherein the upper side of said nut is provided with a duct for taking up thermal expansion of an oil lubricant introduced in said bearing casing.

8. An impeller as claimed in claim 1, wherein the diameters of said supporting plates is greater than the other diameter of the supporting ring, said supporting plates accommodating at their circumference an impeller rim which is centered by means of radial guides on the supporting plates and fixed with the supporting plates by means of bolts.

* * * * *